US005671647A

United States Patent [19]

Mori

[11] Patent Number: 5,671,647

[45] Date of Patent: Sep. 30, 1997

[54] PAPER CUTTER

[75] Inventor: Chuzo Mori, Tokyo, Japan

[73] Assignee: Carl Manufacturing Co., Ltd., Tokyo, Japan

[21] Appl. No.: 500,232

[22] Filed: Jul. 10, 1995

Related U.S. Application Data

[63] Continuation of Ser. No. 204,657, Mar. 2, 1994, abandoned.

[30] Foreign Application Priority Data

Mar. 16, 1993 [JP] Japan ..... 5-081352

[51] Int. Cl.[6] ..... B26D 1/18; B26D 7/02

[52] U.S. Cl. ..... 83/56; 83/455; 83/485; 83/588; 83/614

[58] Field of Search ..... 83/455, 485, 588, 83/614, 56

[56] References Cited

U.S. PATENT DOCUMENTS

| | | | |
|---|---|---|---|
| 162,841 | 5/1875 | Mayer | 83/455 |
| 228,686 | 6/1880 | Smith | 83/455 |
| 3,237,497 | 3/1966 | Cook | 83/455 X |
| 3,292,477 | 12/1966 | Raftery | 83/614 X |
| 3,301,117 | 1/1967 | Spaulding | 83/455 |
| 5,069,097 | 12/1991 | Mori | 83/455 X |

FOREIGN PATENT DOCUMENTS

| | | |
|---|---|---|
| 1-132394 | 9/1989 | Japan . |
| 5-245794 | 9/1993 | Japan . |

*Primary Examiner*—Eugenia Jones

*Attorney, Agent, or Firm*—Oliff & Berridge

[57] ABSTRACT

A paper cutter comprising: a bed for placing paper to be cut thereon; a rail mounted on the bed; a slider made slidable along the rail; and a rotary blade carried by the slider for cutting the paper as the slider is moved. Further comprised are springs for supporting the two ends of the rail therethrough on the bed so that the rail may move up and down. The rail has its lower face formed on its end edge with a cutting position determining face such that the slider is fitted on the rail in a position where the rotary blade runs along the positioning face. With this construction, the rail itself is supported in a floating state on the bed. As a result, the paper is cut with the rotary blade by lowering the floating rail with the depression of the slider and by clamping the paper under pressure only at the portion to be cut between the rail and the bed as the slider is moved. Thus, the construction is simplified with little cutting resistance, and the paper is not displaced even if clamped at the portion between the rail and the bed.

2 Claims, 8 Drawing Sheets

PAPER CUTTER

This is a Continuation of application Ser. No. 08/204,657 filed Mar. 2, 1994, now abandoned.

BACKGROUND OF THE INVENTION

1. Field of the Invention

The present invention relates to a paper cutter to be used as an office article and, more particularly, to a paper cutter which has its construction simplified but can cut stacked sheets of paper precisely while holding them on a bed without any displacement.

2. Description of the Related Art

In a paper cutter of the prior art, as shown in FIG. 12, a rail 3 has its one end supported by a support portion 2 over a bed 1, and a paper holding plate 4 is mounted on the rail 3. When paper is to be cut using the paper cutter, the other end portion of the rail 3, which has its one end supported by the support portion 2, is turned upward on its hinged portion, and the paper is placed on the bed 1. Next, the rail 3 is turned downward on its hinged portion to hold the paper on the bed 1 with the paper holding plate 4. A lock mechanism 6 carried on the free end portion of the rail 3 is retained by a retaining member 7 which is fixed on the bed 1, to retain the paper held by the paper holding plate 4. Then, a slider (as disclosed in Japanese Utility Model Application No. 26776/1988), which is fitted on the rail 3, is slid to cut the paper by the action of a rotary blade which is carried by the slider 5. The cutting position of the paper is determined with reference to the edge of the paper holding plate 4 so that the paper is cut by the rotary blade having its side turning in contact with the edge of the paper holding plate 4.

The paper cutter of the prior art described above performs adequately if only a few sheets of paper are stacked on the bed, even if the rail and the paper holding plate are made integral. In case, however, the number of stacked paper sheets is large, the paper holding plate is moved together with the rail when the rail is depressed on its one end near the support portion 2, so that the large number of stacked sheets are principally held at the side of the hinged end of the rail. As a result, the stacked sheets are cut with such a displacement as is caused by the holding force of the paper holding plate. Thus, there arises a problem that the sheets of paper are irregularly cut out of precision in size.

At the time of determining the cutting position of the paper, on the other hand, not only the fall but also the paper holding plate has its leading end lifted with respect to the hinged end of the rail so that the cutting position is difficult to determine with respect to the edge of the paper holding plate. Because of this positioning, the cutting operation cannot be started before the rail is depressed to confirm the cutting position. As a result, the stacked paper sheets are also displaced at the time of determining the cutting position. Thus, there also arises the problem that the sheets of paper are irregularly cut out of precision in size.

I have already filed a paper cutter, which could solve the above-specified problems of the prior art, for patent in Japanese Application No. 80462/1992, but this paper cutter is not put into practice. This paper cutter is constructed such that the rail and the paper holding plate are separated from each other, such that the paper holding plate is so supported through springs on the base as to move vertically upward and downward, and such that the stacked sheets of paper to be cut are clamped and held without any displacement between the paper holding plate and the bed by depressing the paper holding plate through the rail.

On the other hand, a simplified paper cutter has been already put into practice, as shown in FIG. 11. This simplified paper cutter is constructed such that a rail 9 is fixed on an ordinary scale (or paper holder) 8 to integrate themselves substantially, and such that a slider 10 is fitted on that rail 9. Thus, the stacked paper sheets are cut by placing them on a cutter seat, for example, by holding the paper sheets forcibly through the scale 8 by the left hand of an operator, and by moving a slider 10 while protruding a cutter blade (not the rotary blade) from its casing 12 by depressing a projection 11 with the right hand.

However, either of the examples of the prior art described above has the following problems to be solved, because it is premised that the sheets of paper are held in the forcibly fixed state on the bed or the cutter seat by the paper holder. First of all, in the Japanese Patent Application No. 80462/1992, the rail and the paper holding plate are separated so that the sheets of paper are fixed and held by depressing the paper holding plate, which has its two ends supported on the bed through the springs, by the rail. Thus, there arise problems that the drive mechanism for the rail is complicated which increases the number of assembly/disassembly steps and raises the production cost of the office article.

Moreover, a embodiment of the prior art shown in FIG. 11 is simple in its construction but is caused to cut the stacked sheets of paper by holding the scale directly with the hand of the operator to fix the paper sheets and by moving the slider with the cutter blade (not the rotary blade) being protruded. A force displaces the paper sheets because of the resistance during the cutting operation between the stacked sheets and the cutter blade, so that the fixed state of the paper sheets changes during use, thereby diminishing the precision and convenience of the paper cutter. Moreover, if the number of stacked sheets of paper is very large, another problem arises because all the paper sheets cannot be accommodated by the paper cutter at one time.

SUMMARY OF THE INVENTION

The present invention contemplates to break the fixed concept that the paper to be cut has to be fixed reliably over the entire dimension to be cut, and to provide a paper cutter which has its construction simplified by holding the paper only at its portion to be cut, which is freed from any displacement even if a large number of sheets of paper are stacked, and with which the cutting position can be determined easily.

In order to solve the above-specified problems, according to the present invention, there is provided a paper cutter comprising: a bed for placing paper to be cut thereon; a rail mounted on said bed; a slider made slidable along said rail; and a rotary blade carried by said slider for cutting the paper as said slider is moved, the rail having springs for supporting the two ends of said rail therethrough on said bed so that said rail may move up and down, and wherein said rail has its lower face formed on its end edge with a cutting position determining face such that said slider is fitted on said rail in a position where said rotary blade runs along said positioning face.

With the construction specified above, the present invention has the following operation. In the paper cutter of the type in which the paper is placed on the bed so that it is cut by the rotary blade carried by the slider while moving the slider along the rail mounted on the bed, the rail has its two ends so supported over the bed through the springs as to move up and down. As a result, the rail itself is supported to float over the bed. The rail in the floating state is depressed by the depression of the slider when the paper is to be cut, so that the paper can be clamped under pressure only at the portion to be cut between the rail and the bed in accordance with the movement of the slider. Because the rotary blade exerts force on the paper primarily in a direction perpendicular to the bed, a negligible displacement of the paper occurs even if the paper is partially clamped under pressure at its portion to be cut between the rail and the bed. In contrast, a non-rotary blade produces significant force in the cutting direction, which produces a moment between the cutting force and the holding force of the rail. Moreover, the rail has its lower face formed on its end edge with the cutting positioning face, and the slider is fitted on the fall at the portion where the rotary blade runs along the positioning face, so that the cutting position can be easily determined by lowering the rail supported in the floating state by the positioning face formed on the rail. At the same time, the rotary blade can cut the paper at the determined position because it is positioned along the positioning face.

DESCRIPTION OF THE PREFERRED EMBODIMENTS

Figure 1:
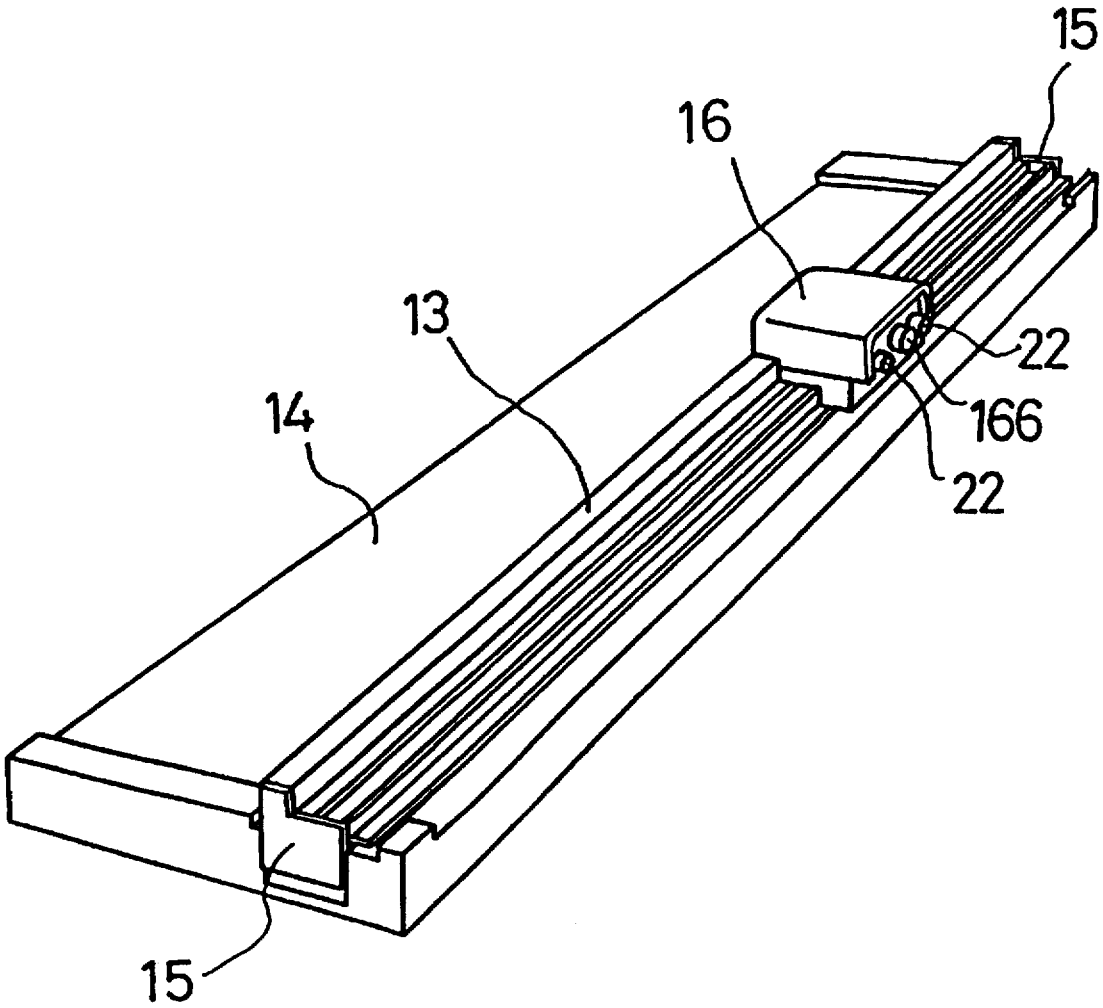
FIG. 1 is a perspective view showing the entire construction of one embodiment of the present invention.
Figure 2:
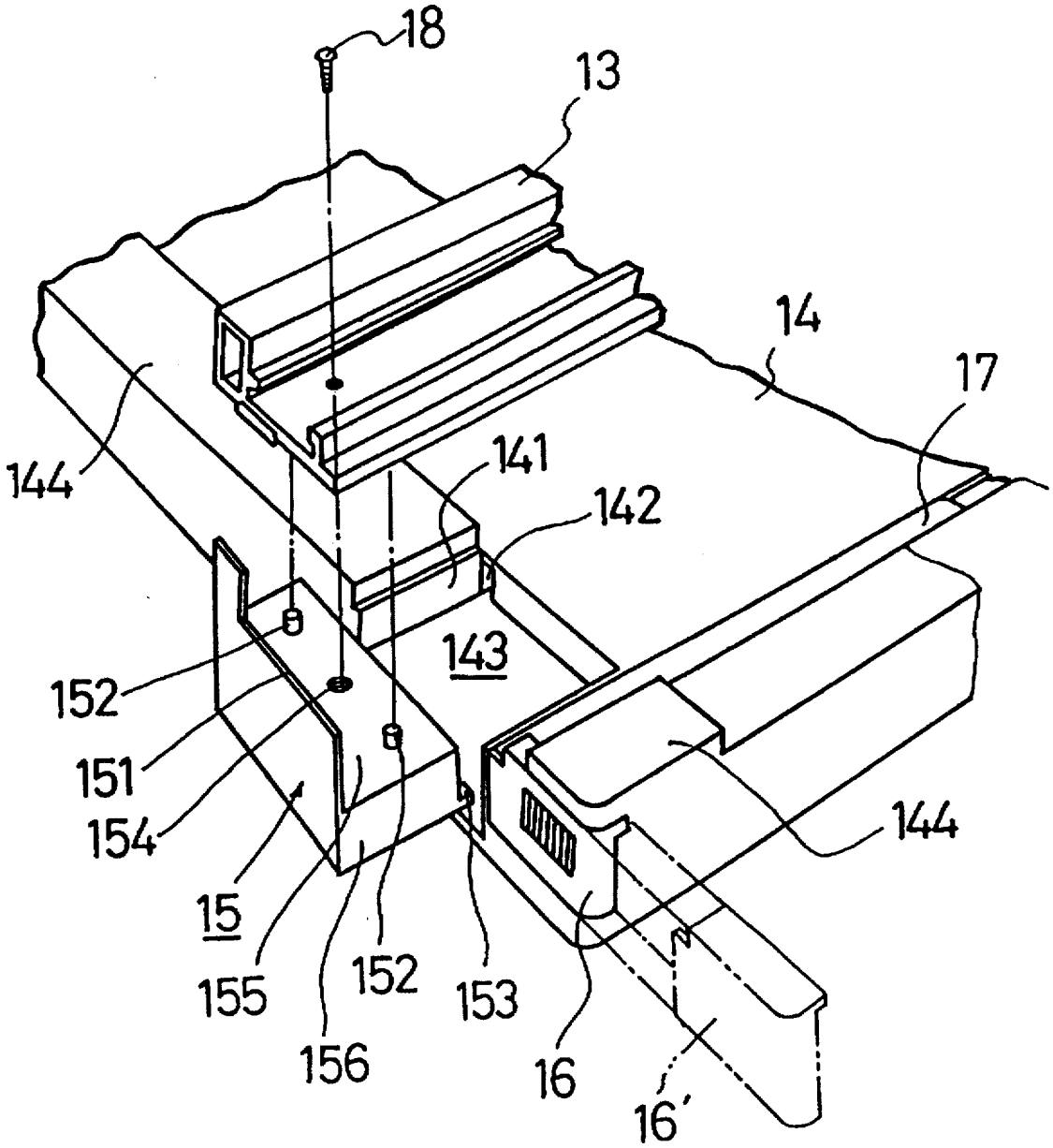
FIG. 2 is an exploded perspective view showing the assembly/disassembly of the end portion of a rail of FIG. 1.

The present invention will be described in the following in connection with one embodiment with reference to the accompanying drawings. FIG. 1 is a perspective showing the exterior of the present embodiment. A rail 13 has a central axis and two ends supported by support members 15 which are vertically movably mounted on a bed 14 through springs. Reference numeral 16 designates a slider which is movably fitted on the rail 13 for movement along an axial direction of the rail and equipped with a rotary blade. FIG. 2 is a perspective diagram showing the assembly/disassembly of the end portion of the rail, which are supported by the support members 15. Support member 15 is formed at its back with a stopper portion 151 for preventing the slider 16 from coming out of the rail 13. The support member 15 is further formed in its rail fixing face 155 with two projections 152 for positioning the rail 13 and a threaded hole 154 for fixing the rail 13. Moreover, the lower portion of the front face of the rail fixing face 155 is formed at its two sides with projections 153 (although one of them is not shown) for regulating the rise of the support member 15. On the other hand, the support member 15 has vertical sides presenting guide faces 156 for guiding the support member 15 moving up and down.

The bed 14 is formed with: guide faces 141, on which the guide faces 156 of the support member 15 slide; and a recess 143 which is formed with holes 142 (although one of them is not shown), into which are to be inserted the projections 153 formed on the support member 15. On the other hand, the bed 14 is formed at its two end portions with positioning lands 144 for positioning sheets of paper to be cut. In front of the bed 14, moreover, there is fitted a cutter seat 17 which is arranged in parallel with the rail 13 mounted on the bed 14, for accepting the protruding rotary blade. The front of the bed 14 is further provided with a cutter seat holder 16 which can be brought into and out of position for exchanging the cutter seat 17. Numeral 18 designates a screw for fixing the rail 13 on the support member 15.

Figure 3:
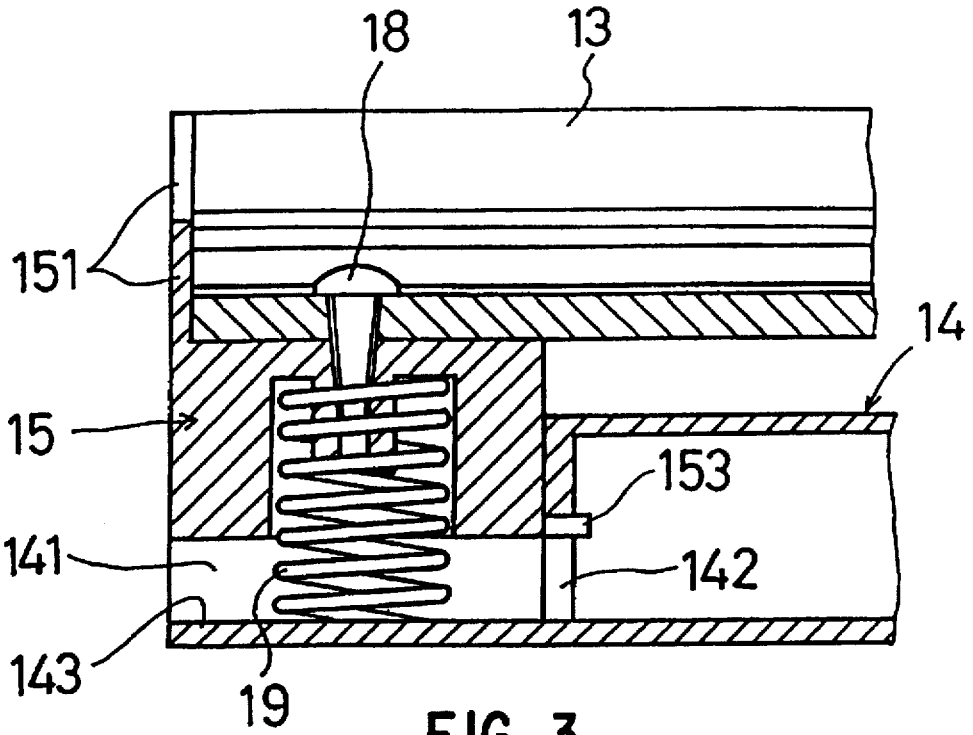
FIG. 3 is a longitudinal section showing an essential portion of the rail end portion of FIG. 1.

FIG. 3 is a section showing the state in which the rail 13 is assembled on the support member 15. This support member 15 is vertically movably supported in the recess 143 with its projections 153 being fitted in the holes 142, and the rail 13 has its two ends fixed on the support members 15 by the screws 18. As a result, the rail 13 has its two ends substantially supported by the springs 19 through the support members 15 so that its rise is regulated by the abutment of the projections 153 against the upper portions of the holes 142 against the lifting forces of the springs 19. Thus, the rail 13 and the bed 14 are positioned generally in parallel to leave a gap a between the back face of the former and the upper face of the latter.

Figure 6:
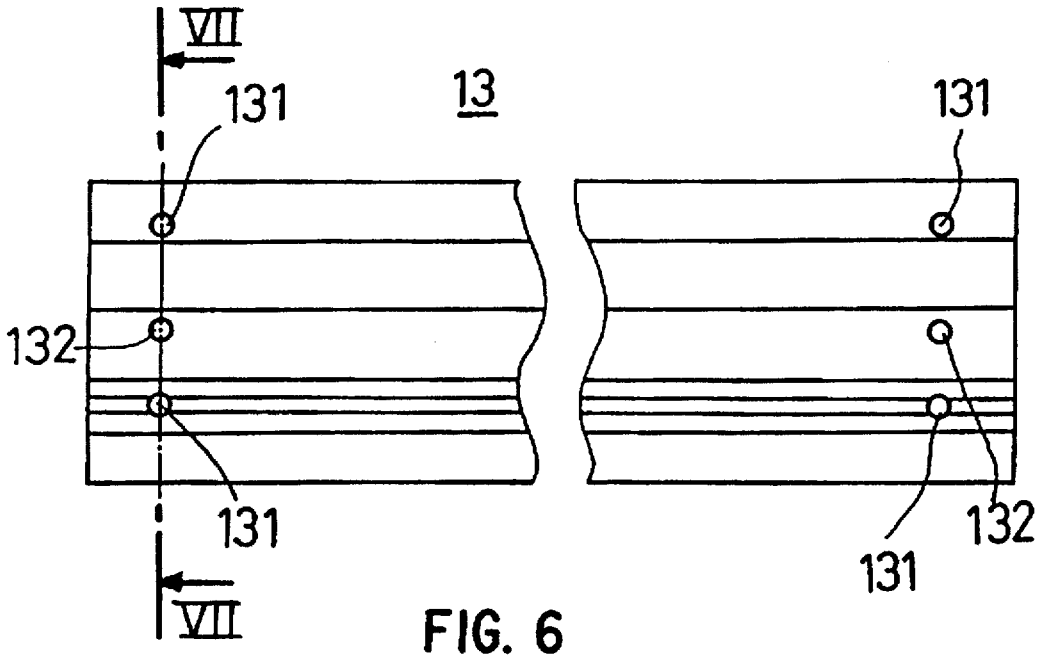
FIG. 6 is a top plan view showing the rail of FIG. 1.
Figure 7:
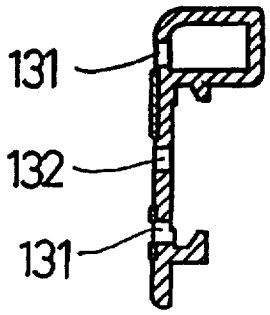
FIG. 7 is a transverse section taken along line VII—VII of FIG. 6.
Figure 8:
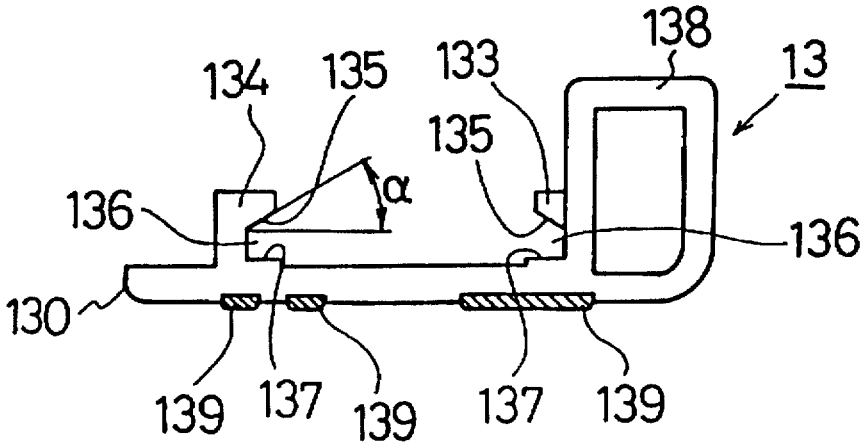
FIG. 8 is a side elevation of FIG. 6.

As shown in FIG. 6 presenting a top plan view of the rail and in FIG. 7 presenting a section of the rail, the rail 13 is formed at its two ends with through holes 131, in which the projections 152 shown in FIG. 2 are to be fitted, and screw holes 132 into which the screws 18 are to be driven. FIG. 8 is side elevation of the rail 13. This rail 13 is formed with guide portions 134 and 138 raised from the upper face thereof. The guide portion 138 is formed with a guide projection 133. The guide projection 133 and guide portion 134 are formed at their insides with slopes 135 having a sloping angle of alpha (e.g., 30 degrees). These slopes 135 form, together with horizontal faces 137, guide spaces 136 for guiding the guide members of the slider 16. On the other hand, the rail 13 is equipped substantially all over its length with hold members 139 (made of sponge or the like), which are slightly raised from the back of the rail 13 for holding the paper to be cut. Moreover, the rail 13 is formed on its end edge with a positioning face 130 for positioning the cutting position.

Figure 9:
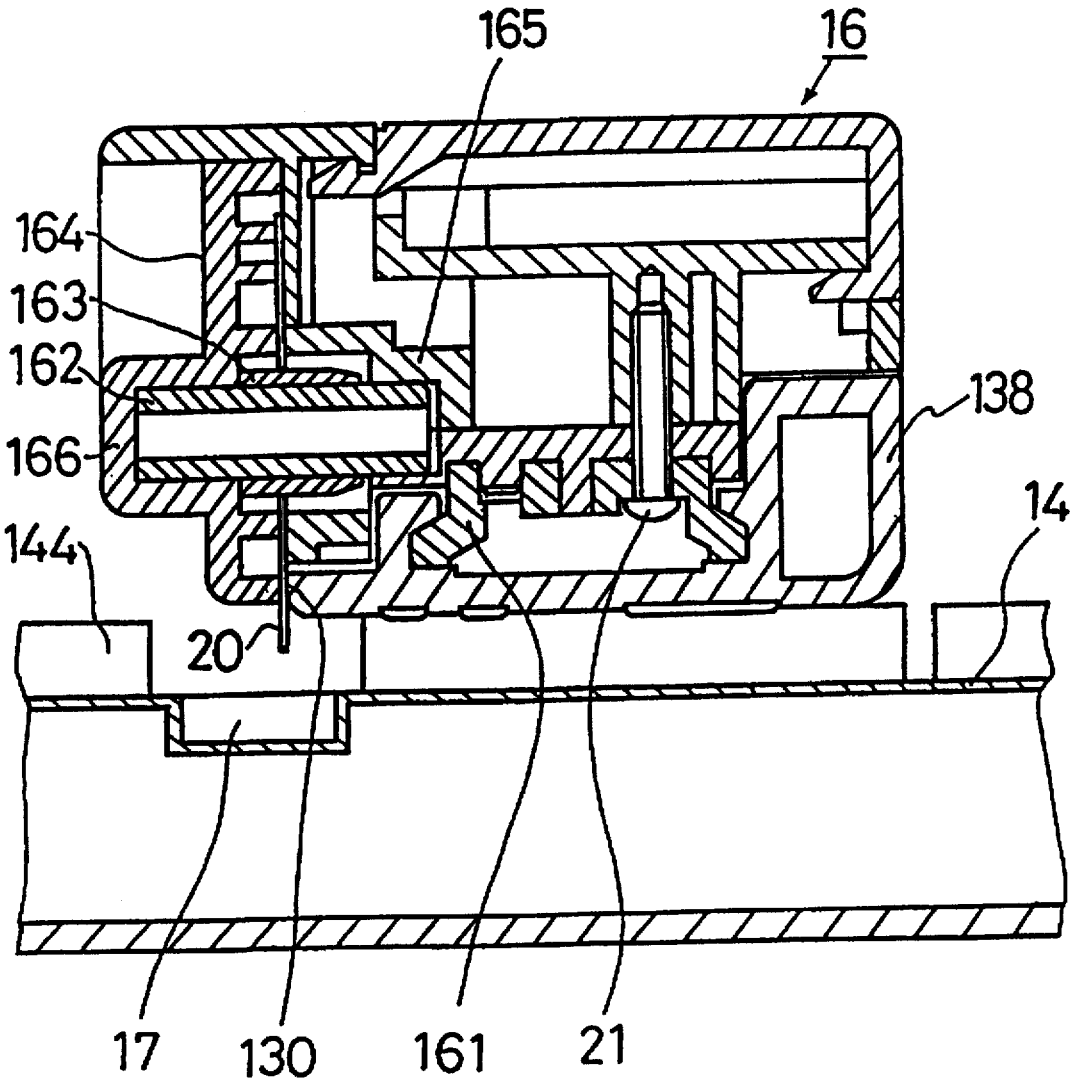
FIG. 9 is a vertical section taken at the rotary blade portion of the slider of FIG. 1.
Figure 10:
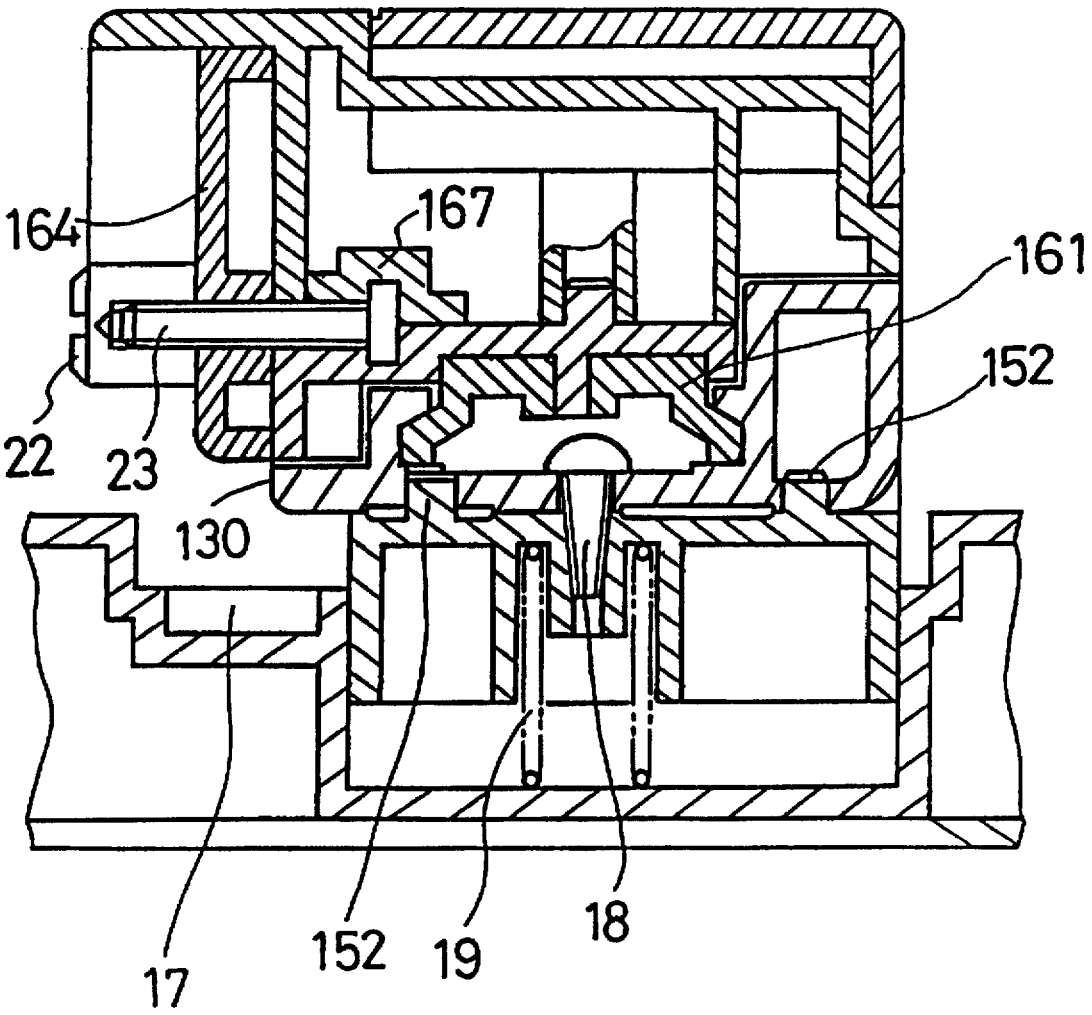
FIG. 10 is a vertical section taken at the bolt portion of the slider of FIG. 1.
Figure 11:
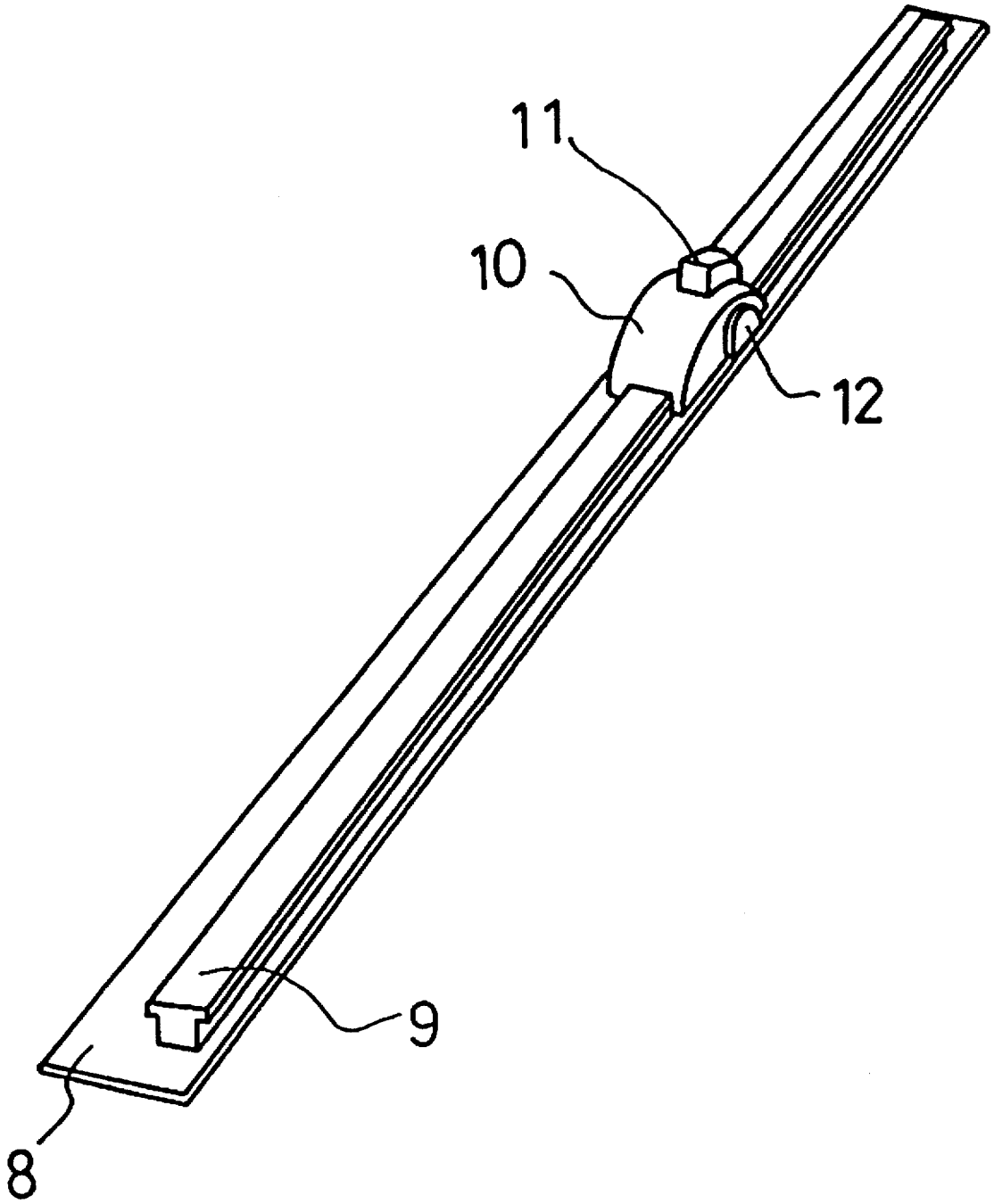
FIG. 11 PRIOR ART
FIG. 11 is a perspective view showing the simplified cutter of the prior art.
Figure 12:
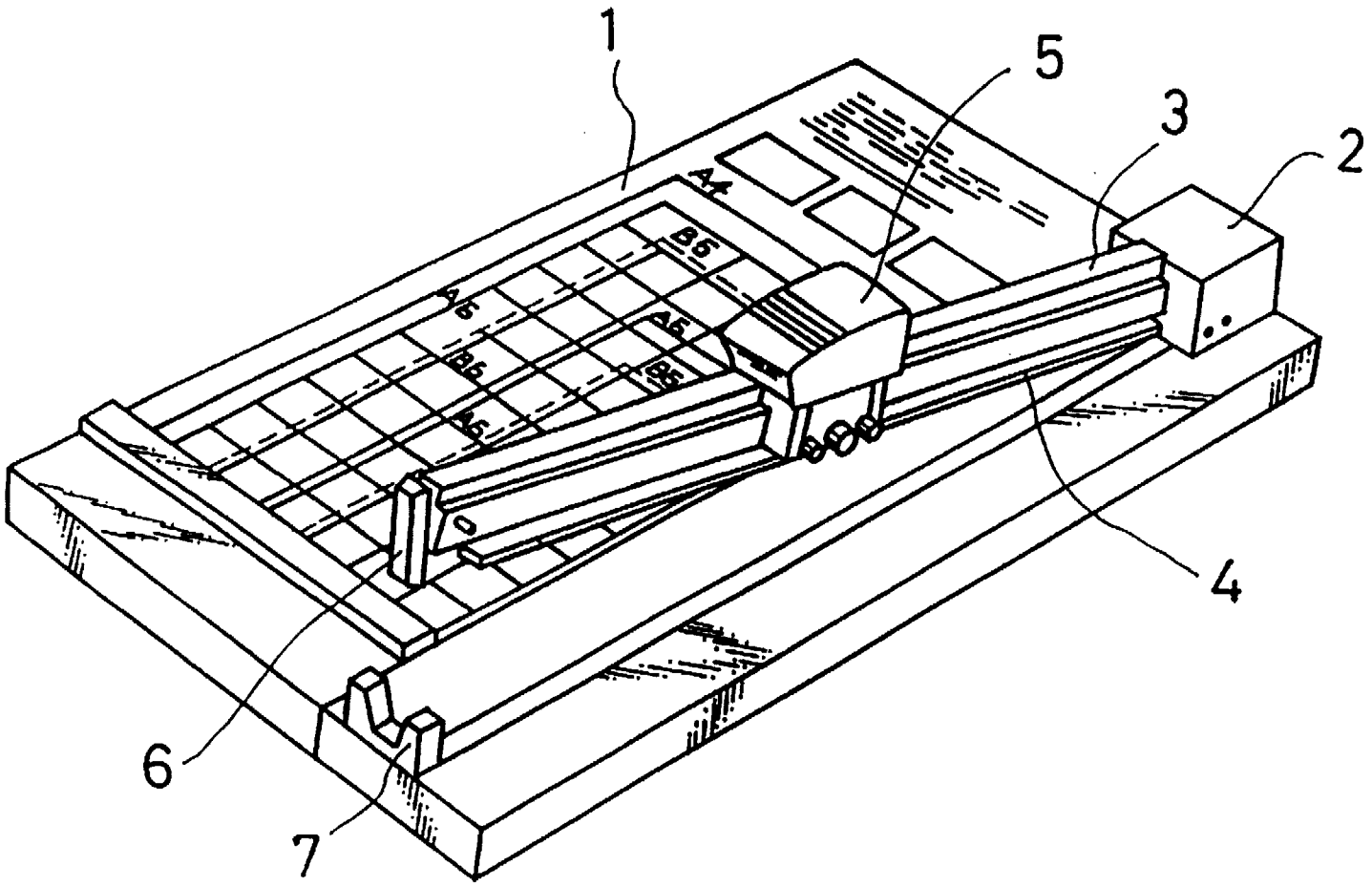
FIG. 12 PRIOR ART
FIG. 12 is a perspective view showing the cutter of the prior art.

In the body of the slider 18, as shown in FIG. 9, there are mounted by means of screws 21 the guide members 161 which are shaped so similar to the guide spaces 136 that they may be fitted in the guide spaces 136. A shaft 162 has its two ends borne by both a bearing 165 fitted in the slider body and a bearing 166 fitted in a cover 164 which is removably mounted in the slider body. On the shaft 162, there is mounted through a plain bearing 163 a rotary blade 20. This rotary blade 20 is held in contact with the positioning face 130 of the rail 13 when the guide members 161 are fitted in the guide spaces 138. As shown in FIG. 10, the slider body, as designated at 167, is equipped with anchor bolts 23, which are to be inserted into the bolts holes formed in the cover 164. Thus, the cover 164 is removably attached to the slider body by means of nuts 22 so that the rotary blade 20 shown in FIG. 9 can be replaced.

The operations of the present embodiment thus constructed will be described in the following. At first, the assembly will be described with reference to FIG. 2. The springs 19 are mounted on the back of the support members 15, and the projections 153 are inserted into the holes 142 (as shown in FIG. 3). After this, the holes 131 formed in the rail 13 are fitted on the projections 152 formed on the rail fixing faces 143 of the support members 15, and the assembly is completed merely by fixing the rail 13 on the support members 15 by means of the screws 18. In the state thus assembled, the rail 13 can be so supported by the springs 19 through the support members 15 as to float with respect to the bed 14, as shown in FIG. 4.

Figure 4:
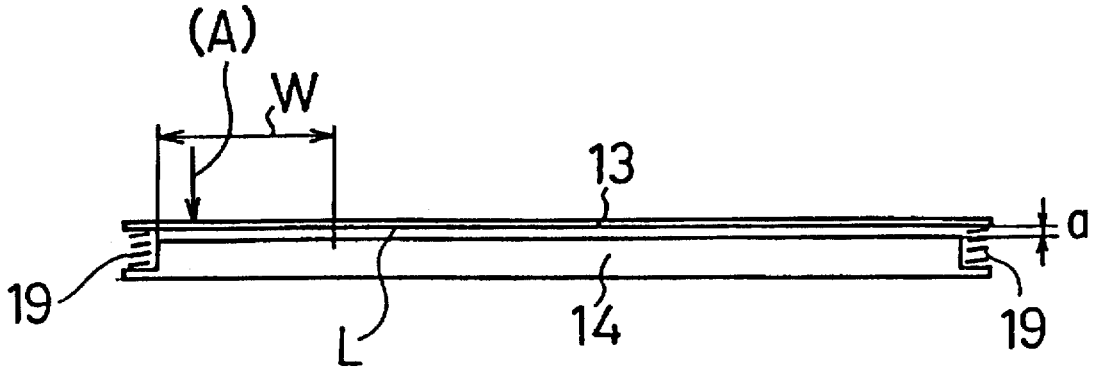
FIG. 4 is a schematic diagram showing the vertical motions of the rail of FIG. 1 when a pushing force is applied to the end portion of the rail.
Figure 5:
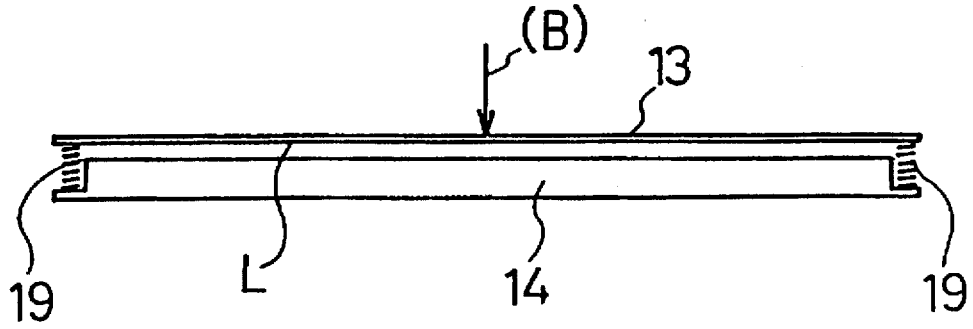
FIG. 5 is a schematic diagram showing the vertical motions of the rail of FIG. 1 when a pushing force is applied to the center of the rail.

During operation, if the slider 16, as indicated by arrow (A) of FIG. 4, is depressed, then the rail 13 has its back face L lowered at the portion pressed by the slider 16 but is left floating above the paper at its other end by the gap a, because it is supported in the floating state by the springs 19. If, on the other hand, the slider 16 positioned, as indicated by arrow (B) of FIG. 5, i.e., at a central portion of the rail 13, is depressed, the central portion is lowered in parallel with the bed 14 while the ends remain above the bed.

Thus, if the rail 13 is supported in the floating state by the springs 19 and if the slider 16 is moved while being depressed, the rail 13 can be freely moved in the vertical direction, as the slider 16 is moved, by the balance among the elastic force of the springs 19, the rigidity of the rail 13 and the depression of the slider 16. As a result, the paper to be cut can be clamped between the rail 13 and the bed 14 within a cutting range, as indicated at W in FIG. 4, in accordance with the movement of the slider 16. Thus, since the paper is clamped in the cutting range only and since the rotary blade 20 is used, no substantial cutting resistance is established by the rotary blade 20. Even if the paper is clamped under pressure in the cutting range between the rail 13 and the bed 14, it is not displaced so that the stacked sheets can not shift and become offset from one another. The rail 13 is laterally fixed on the support members 15 because the guide faces 156 of the support members 15 and the guide faces 141 of the bed 14 are in sliding contact twisting of the rail in the axial direction of the rail. A first direction is defined as the direction perpendicular to the axial direction of the rail and parallel to the bed. The rail 13 is prevented from any tilting along the axial direction of the rail when it is deformed by the depression of the slider 16 while having its back face being held in parallel in the first direction with the upper face of the bed 14. Thus, the paper is clamped only in the cutting range by the uniform depression between the whole back face of the rail 13 (in the horizontal direction) and the upper face of the bed 14 so that its stacked sheets can be better prevented from any displacement. Thanks to the hold members 139 on the back face of the rail 13, still moreover, the aforementioned depression of the whole back face of the rail 13 can be uniformly transmitted to the paper so that the stacked sheets of paper can be further prevented from the displacement.

Since the cutting positioning face 130 is formed on the end edge of the lower face of the rail 13 and since the slider 16 is fitted on the rail 13 in the position where the rotary blade 20 runs along the positioning face 130, the cutting position can be easily determined by the positioning face 130 formed on the rail 13. And, the rotary blade 20 is positioned along the positioning face 130 so that the paper can be cut as positioned. At the time of determining the cutting position, moreover, the rail 13 is urged by the lifting elastic force of the springs 19 against projections 153 and the holes 142 so that it is supported in the floating state while being held at the constant gap from and in parallel with the upper face of the bed. As a result, the cutting position can be easily determined while preventing the stacked paper sheets from being displaced.

At the cutting time, on the other hand, the rail 13 is deformed to clamp the paper to be cut in the cutting range between itself and the bed 14 by making use of the depression of the slider 16 so that the paper cutter can be effectively used as an office article. For example, the paper can also be cut with the slider 16 being depressed by the left hand of the operator and with the paper to be cut being lightly held at its portion apart from the rail 18 by the free right hand.

As has been described in detail, according to the present invention, the rail has its two ends so supported over the bed through the springs as to move up and down without twisting the central axis of the rail. As a result, the rail itself is supported to float over the bed. The rail in the floating state is depressed by the depression of the slider when the paper is to be cut, so that the paper can be clamped under pressure in the cutting range only between the rail and the bed in accordance with the movement of the slider. Thanks to the use of the rotary blade, in contrast to a non-rotary blade, the cutting resistance is minimized so that no displacement of the paper occurs even if the paper is clamped under pressure at its portion to be cut between the rail and the bed. Thus, it is possible to prevent the stacked sheets of paper from being displaced. Moreover, the rail has its lower face formed on its end edge with the cutting positioning face, and the slider is fitted on the rail at the portion where the rotary blade runs along the positioning face, so that the cutting position can be easily determined by the positioning face formed on the rail. At the same time, the rotary blade can cut the paper at the determined position because it is positioned along the positioning face. Thus, the rail is supported in the floating state and is deformed in the cutting range by the depression of the slider to clamp the paper under pressure only at the portion to be cut. Thus, the paper cutter provides simplified and effective operation.

What is claimed is:

1. A method for cutting paper in a paper cutter having: a bed with an upper face for supporting at least one sheet of paper; a rail having opposite ends each supported by a corresponding support member on the bed, the rail defining a central axis extending in an axial direction of the rail and a transverse axis extending in a first direction perpendicular to the axial direction of the rail and parallel to the bed and having a bottom face parallel in the first direction to the upper face of the bed, the bottom face defining a positioning edge extending along the axial direction of the rail, and a slider slidably supported for movement in the axial direction of the rail and having a rotary cutter, the method comprising:

(a) urging the support members away from the bed with compression springs to define a gap between the bottom and upper faces;

(b) sliding guide faces of the support members against opposing guide faces of the bed so that the bottom face of the rail moves relative to the upper face of the bed but remains parallel in the first direction thereto without twisting about the axial direction of the rail;

(c) depressing the slider and moving the slider along the axial direction of the rail with a face of the rotary cutter in sliding contact with the positioning edge thereby cutting the paper; and (d) providing a rigidity of the rail in relation to an elastic force of the compression springs so that depression of the slider bends the rail along the axial direction of the rail to clamp the at least one sheet of paper between the bottom and upper faces only in a cutting range in a vicinity of the slider, thereby maintaining a gap between the bottom and upper faces along the axial direction of the rail except within the cutting range.

2. A paper cutter comprising:

a bed having an upper face for supporting at least one sheet of paper;

two support members mounted on the bed, each support member having opposing guide faces in sliding contact with corresponding opposing guide faces in the bed and a compression spring for urging the support member away from the bed;

a rail defining a central axis extending in an axial direction of the rail and a transverse axis extending in a first direction perpendicular to the axial direction of the rail and parallel to the bed, the rail including a bottom face parallel in the first direction to the upper face of the bed, the rail having opposite ends each supported in a corresponding support member so that sliding contact among the guide faces of the bed and support member moves the bottom face of the rail relative to the upper face of the bed but maintains the bottom face of the rail parallel in the first direction to the upper face of the bed without twisting about the central axis of the rail, the bottom face defining a positioning edge extending in the axial direction of the rail and the springs urging the rail away from the bed to define a gap between the bottom and upper faces;

a slider slidably supported by the rail for movement in the axial direction of the rail, the slider supporting a rotary cutter having a face in sliding contact with the positioning edge of the rail; and an elastic force of the springs urging the ends of the rail away from the bed while the rigidity of the rail is such that depression of the slider towards the bed bends the rail along the axial direction of the rail to clamp the at least one sheet of paper between the bottom and upper faces only in a cutting range in a vicinity of the slider, the gap between the bottom and upper faces existing along the rail except within the cutting range.

* * * * *